US010737483B2

(12) United States Patent
Lestrange et al.

(10) Patent No.: US 10,737,483 B2
(45) Date of Patent: Aug. 11, 2020

(54) PATTERN-FREE ANILOX INKING SYSTEM AND METHOD

(71) Applicants: Xerox Corporation, Norwalk, CT (US); Palo Alto Research Center Incorporated, Palo Alto, CA (US)

(72) Inventors: Jack T. Lestrange, Macedon, NY (US); Gregory B. Anderson, Emerald Hills, CA (US); Peter J. Knausdorf, Henrietta, NY (US); Joanne L. Lee, Rochester, NY (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 15/898,721

(22) Filed: Feb. 19, 2018

(65) Prior Publication Data

US 2019/0255833 A1 Aug. 22, 2019

(51) Int. Cl.
*B41F 13/193* (2006.01)
*B41F 31/04* (2006.01)
(Continued)

(52) U.S. Cl.
CPC ..... *B41F 13/193* (2013.01); *B41F 7/04* (2013.01); *B41F 7/20* (2013.01); *B41F 9/065* (2013.01); *B41F 31/02* (2013.01); *B41F 31/027* (2013.01); *B41F 31/04* (2013.01); *B41F 31/06* (2013.01); *B41F 31/08* (2013.01); *B41F 31/18* (2013.01); *B41F 31/20* (2013.01); *B41P 2200/22* (2013.01); *B41P 2231/00* (2013.01); *B41P 2251/10* (2013.01)

(58) Field of Classification Search
CPC .... B41F 1/40; B41F 1/46; B41F 9/063; B41F 9/061; B41F 3/81; B41F 31/04
See application file for complete search history.

(56) References Cited

U.S. PATENT DOCUMENTS 5,003,876 A * 4/1991 Harrison ..... B41F 31/00 101/350.5
2001/0020426 A1* 9/2001 Bachmeir ..... B41F 31/00 101/350.1

(Continued)

FOREIGN PATENT DOCUMENTS

GB 1159851 7/1969

OTHER PUBLICATIONS

European Search Report for corresponding European Patent Application No. EP19156803 dated Sep. 3, 2019.

*Primary Examiner* — Jennifer E Simmons
*Assistant Examiner* — Quang X Nguyen
(74) *Attorney, Agent, or Firm* — Caesar Rivise, PC

(57) ABSTRACT

In a digital inking system having an anilox member that carries a patterned metered layer of ink to a digital imaging member, and a doctor blade that removes excess ink from the surface of the anilox member resulting in the patterned metered layer, an overfill form roller in rolling contact with the anilox member adds an overcoat layer of ink on the patterned metered layer for transfer of both layers of ink to the digital imaging member. The overcoat layer of ink uniformly covers all regions of the anilox member and the mattered metered layer of ink, including lands of the anilox cell walls to make the combined layers of ink pattern-free.

20 Claims, 3 Drawing Sheets

(51) Int. Cl.

| | |
|---|---|
| ***B41F 31/08*** | (2006.01) |
| ***B41F 31/20*** | (2006.01) |
| ***B41F 7/04*** | (2006.01) |
| ***B41F 7/20*** | (2006.01) |
| ***B41F 31/02*** | (2006.01) |
| ***B41F 31/18*** | (2006.01) |
| ***B41F 31/06*** | (2006.01) |
| ***B41F 9/06*** | (2006.01) |

(56) References Cited

U.S. PATENT DOCUMENTS

| | | | | |
|---|---|---|---|---|
| 2002/0178944 | A1* | 12/2002 | Hess | B41F 22/00<br>101/177 |
| 2006/0016354 | A1* | 1/2006 | Telljohann | B41F 31/027<br>101/348 |
| 2013/0025487 | A1 | 1/2013 | Liu | |
| 2015/0375497 | A1 | 12/2015 | Stowe et al. | |

* cited by examiner

PATTERN-FREE ANILOX INKING SYSTEM AND METHOD

FIELD OF DISCLOSURE

This invention relates generally to ink-based digital printing systems, and more particularly, to inking systems and methods for use in lithographic offset printing systems.

BACKGROUND

In related art digital offset lithographic printing systems, a dampening system applies a thin layer of fountain solution onto a surface of a digital offset imaging plate. An imaging system then evaporates the fountain solution film in an image area using a high power laser. A latent image is formed on the surface of the digital offset imaging plate. The latent image corresponds to a pattern of the applied fountain solution that is left over after evaporation.

An inking system may be used to apply a uniform layer of ink over a surface layer of the imaging plate. Typically, ink supplied on an inker form roll of the inking system is depleted from the form roll as the ink is transferred from the form roll onto the imaging plate. As a portion of the imaging plate surface containing the latent image passes through the inking system, the ink deposits onto the plate regions where the laser has vaporized the fountain solution. Conversely, ink is rejected by the plate regions where fountain solution remains. The resulting ink image is then transferred to paper or other print media via pressure.

Ink from the inker form roll may split onto the imaging member during ink transfer, leaving behind some ink on the form roll that may lead to uneven ink thereon. During the supplying of ink onto the form roll, not all areas on the form roll are covered with the same thickness of ink. Printing irregularities can result if an ink layer on the form roll is uneven and has areas of barely-layered ink that cause corresponding lighter areas in image prints.

To offset this problem, the inker form roll may be an anilox member, such as an anilox roll. However, one drawback for anilox rolls is non-uniform ink deposition on a micro scale. Since ink is transferred out of the cells of an anilox roll, if the ink does not spread after deposition, a pattern of the anilox cells will be visible in the deposited ink. This is largely due to the fact that most of the ink transfers out of the center of the cell and little ink transfers from the lands (top surface of the cell walls) of the anilox cells.

Current anilox inking systems may set up the metering blade such that ink uniformly hydroplanes underneath the blade. That is, the metering blade is spatially separated from the anilox roll to allow ink to coat the roller surface, including the lands thereof. Operating an inker in this manner results in better solid area uniformity, but is somewhat difficult to control temporally, since the amount of ink that hydroplanes underneath the blade is sensitive to many factors (e.g., ink temperature, ink viscosity, amount of ink in the inker, blade pressure, blade angle).

As such, there is a need to overcome the deficiencies of conventional printing technology for printing variable data. It would be beneficial to produce digital prints of high image quality with pattern-free inking of the print media (e.g., print substrates). Ink-based digital printing is understood to refer to ink-based printing of variable image data for producing images on media that are changeable from one image to a next image with each subsequent printing on the media in an image forming process.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a digital offset inking system having an inking apparatus. The inking apparatus may include an anilox member, an ink supply station, a metering member and an overfill roller assembly. The anilox member may have a surface including wells defined therein, with the surface configured to receive and carry the ink for transfer to a digital imaging member. The ink supply station may be in liquid communication with the anilox member to transfer an initial portion of the ink to the surface of the anilox member. The metering member may be in contact with the anilox member and configured to remove excess ink of the initial portion of ink supplied to the anilox member from the surface of the anilox member, resulting in a metered layer of ink on the surface. The overfill roller assembly may be in rolling contact with the anilox member, and may include an overfill form roller configured to add an overcoat layer of ink on the metered layer of ink downstream the metering member for transfer of both the metered layer of ink and the overcoat layer of ink to the digital imaging member.

According to aspects illustrated herein, an inking method may include transferring ink from an ink supply station onto a surface of an anilox member, with the surface including wells defined therein to receive and carry the ink for transfer to a digital imaging member. The inking method may further include metering a metered layer of the ink from the transferred ink onto the surface of the anilox member with a metering member in contact with the anilox member, the metering member configured to remove excess ink transferred to the anilox member from the surface of the anilox member resulting in a metered layer of the ink on the surface. The inking member may still further include adding an overcoat layer of the ink on the metered layer of ink downstream the metering member with an overfill roller assembly including an overfill form roller in rolling contact with the anilox member, and transferring both the metered layer of the ink and the overcoat layer of the ink to the digital imaging member.

According to aspects described herein, an inker useful in printing may include an anilox member, an ink chamber, a doctor blade, and an overfill roller assembly. The anilox member may have a surface including wells defined therein, with the surface configured to receive and carry ink for transfer to a digital imaging member. The ink chamber may be in liquid communication with the anilox member to transfer an initial portion of the ink to the surface of the anilox member. The doctor blade may be in contact with the anilox member, and configured to remove excess ink of the initial portion of the ink supplied to the anilox member from the surface of the anilox member resulting in a metered layer of the ink on the surface. The overfill roller assembly may be in rolling contact with the anilox member and include an overfill form roller configured to add an overcoat layer of the ink on the metered layer of ink downstream the doctor blade for transfer of both the metered layer of ink and the overcoat layer of the ink to the digital imaging member. The ink chamber may include a first ink supply configured to transfer the initial portion of the ink to the surface of the anilox member, a second ink supply configured to transfer the overcoat layer of the ink to the overfill form roller, and an ink management system configured to move the ink to the first ink supply and the second ink supply.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
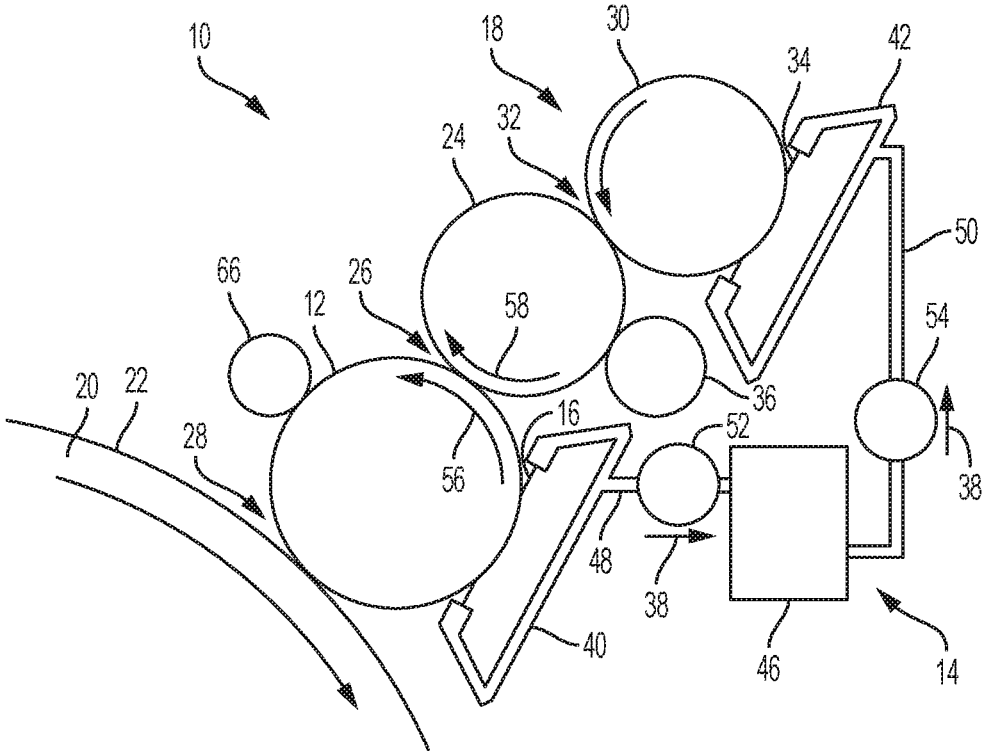
FIG. 1 is a side view of a inking apparatus in accordance with an example of the embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges, are understood to include each and every number and/or fraction between the stated range minimum and maximum. For example, a range of 0.5-6% would expressly include all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

Inking systems or inker subsystems in accordance with embodiments may be incorporated into a digital offset architecture so that the inking system is arranged about a central imaging plate, also referred to as "imaging member". The imaging member may be a cylinder or drum. A surface of the imaging member is reimageable making the imaging member a digital imaging member. The surface is also conformable. The conformable surface may comprise, for example, silicone. A paper path architecture may be situated about the imaging member to form a media transfer nip.

A uniform application of fountain solution may be applied to a surface of the central imaging plate by a dampening system. In a digital evaporation step, particular portions of the fountain solution layer applied to the surface of the central imaging plate may be evaporated by a digital evaporation system. For example, portions of the fountain solution layer may be vaporized by laser patterning to form a latent image. In a vapor removal step, the vaporized fountain solution may be collected by a vapor removal device to prevent condensation of the vaporized fountain solution back onto the imaging plate.

In an inking step, ink may be transferred from an inking system to the surface of the central imaging plate. The transferred ink adheres to portions of the surface of the imaging member where fountain solution has been evaporated. In an image transfer step, the transferred ink may be transferred to media such as paper at a media transfer nip.

In a variable lithographic printing process, previously imaged ink must be removed from the imaging member to prevent ghosting. After an image transfer step, the surface of the imaging member may be cleaned by a cleaning system. For example, tacky cleaning rollers may be used to remove residual ink and fountain solution from the surface of the imaging member.

As noted above, a drawback to an anilox inking system is the potential for non-uniform ink deposition on a micro-scale. Most of the ink on an anilox member transfers out of the center of the anilox cells and little ink transfers from the lands. Digital lithography processes typically use high viscosity inks (e.g., greater than 100 cP) that do not spread much after deposition onto the imaging member. This can result in spatially periodic voids in the solid areas of an ink print that correspond to the spatial frequency of the anilox cell patterns. Flexography may mask this issue because flexo ink is less viscous (e.g., 5 to 10 cP) and can naturally spread to fill any voids. Moreover, since a flexo plate is static, any structured anilox patterns are averaged out over time as the plate passes through the inking system numerous times. However, due to the variable image data requirements of digital ink printing, the imaging member surface is cleaned every revolution, thereby exposing the digital print process to the structured ink deposition exhibited with a single pass-through anilox inking member metering a high viscosity ink.

In examples, an overfill inker, which may include an overfill roller assembly, adds a uniform layer of ink to the anilox member (also referred to as primary anilox roller) before ink transfer to the imaging member. This secondary layer of ink uniformly covers all regions of the primary anilox roller including the lands of the cell walls, similar to what the hydroplane metering accomplishes. This simplifies the setup of an anilox roller with a doctor blade hydroplaning ink over the anilox roller, while retaining beneficial ink coverage on the lands of the anilox roller surface. It is understood that an anilox roller is an anilox roll of designs currently familiar in analog printing.

FIG. 1 depicts an exemplary inking apparatus 10 for digital offset inking in accordance with the embodiments. The inking apparatus 10 includes an inking member (e.g., primary anilox roller 12), an ink supply station 14, a metering member 16, and an overfill roller assembly 18. FIG. 1 shows the inking apparatus 10 arranged with a digital imaging member 20 having a reimageable conformable surface 22.

The primary anilox roller 12 includes an anilox roll with a hard surface (e.g., chrome, ceramic) having wells or cells therein for carrying ink to the imaging member, as well understood by a skilled artisan. The wells may be mechanically or laser etched or engraved, and may be configured to contain a volume of ink. The anilox roller 12 may be located so that a surface of the roller is semi-submerged in an ink supply of the inking apparatus 10, such as an ink housing 40 or ink sump of the ink supply station 14. Alternatively, the anilox roller 12 may come into contact with one or more donor rolls, with one of the donor rolls semi-submerged in the ink housing.

The hard surface of the primary anilox roller 12 enables use of a metering member 16 (e.g., doctor blade) to remove excess ink from the roller. For example, a doctor blade may be applied to the surface of the primary anilox roller 12 for leveling ink supplied to the roller from the ink housing 40 as the primary anilox roller rotates in a process direction 56 to remove excess ink.

The overfill roller assembly 18 may add a uniform overcoat layer of ink to the primary anilox roller 12 before ink transfer to the imaging member 20. This overcoat layer of ink uniformly covers the primary anilox roller surface including the lands of the cell walls enabling uniform ink deposition on a micro-scale without spatially periodic voids that may correspond to the primary anilox roller 12 cell patterns. While not being limited to a particular thickness, the overcoat layer of ink may have a thickness between 0.25 μm and 10 μm, of less than about 5 μm, or less than about 1 μm. The overfill roller assembly 18 may include one or more rollers for uniformly coating the primary anilox roller 12 with the overcoat layer of ink. Specifically, the overfill roller assembly may include a non-rigid form roller 24 that contacts the primary anilox roller 12 at an ink transfer nip 26. The non-rigid form roller 24 may have a non-rigid, conformable surface made of, for example, a rubber such as EPDM or nitrile rubber that is compatible with the ink chemistry. The surface of the non-rigid form roller 24 may include foam. The non-rigid form roller is rotatable in a direction 58 opposing the direction 56 of rotation of the primary anilox roller 12.

The non-rigid form roller 24 may roll with the primary anilox roller 12 and transfer the overcoat layer of ink over the anilox roller surface, including the lands of the anilox cell walls. The non-rigid form roller may be urged against the primary anilox roll 12 and squeeze the ink at the ink transfer nip 26 to spread and smooth the ink as the overfill ink is transferred onto the primary anilox roller. The primary anilox roller 12 cells may already be filled with ink from the ink housing leveled by the metering member 16. The overfill layer of ink from the non-rigid form roller thus may combine with the metered ink in the anilox member 12 cells and cover the lands of the anilox member surface previously scraped free of ink by the metering member. The primary anilox roller 12 then transfers the ink from its surface, including the overcoat layer of ink and ink in the anilox cells to the imaging member surface 22 at nip 28, resulting in a thin layer of the ink (e.g., between about 0.25 μm and 10 μm) on the imaging member surface free of ink voids. This range in ink layer thickness may depend on several factors, including the color or type of the ink, and the depth of the primary anilox cells.

The overfill roller assembly 18 may include an overfill donor roller, for example, an overfill anilox roller 30 that may add the overcoat layer of ink to the first or primary anilox roller 12 via the non-rigid form roller 24. In other words, the overfill donor roller may be an anilox roller 30 that contacts the non-rigid form roller 24 at nip 32. The overfill anilox roller 30 rolls may roll with the non-rigid form roller 24 and deposits the overcoat layer of ink to the non-rigid form roller surface for subsequent transfer of the overcoat layer onto the primary anilox roller 12. The overfill anilox roller 30 may be similar to the anilox roller 12, and have a hard surface (e.g., chrome, ceramic) having wells or cells therein configured to carry ink to the non-rigid form roller 24, as well understood by a skilled artisan. The overfill anilox roller 30 may be located in the inking apparatus 10 so that a surface of the roller is semi-submerged in an ink supply, such as an ink housing 42 or ink sump of the ink supply station 14. Alternatively, the overfill anilox roller 30 may come into contact with one or more donor rolls, with one of the donor rolls semi-submerged in the ink housing. In the examples, excess ink from the ink supply may be scraped off the surface of the anilox roller 30, for example, with a doctor blade 34.

While not being limited to a particular theory, the two anilox rollers 12, 30 may have cells sized with different cell volumes. That is, the anilox roller 12 may have cells with different cell volumes than cells of the anilox roller 30. In an example, the primary anilox roller 12 may include cells with a smaller volume intentionally designed to carry a smaller amount of ink for transfer of the thin layer of ink to the imaging member surface 22. In an example, the overfill anilox roller 30 may have cells with a volume larger than the cells of the primary anilox roller 12 and designed as an excess ink donor, through the non-rigid form roller 24, to provide the overcoat ink that may cover the land pattern of the primary anilox roller. In an example the anilox cell patterns of the primary anilox roller 12 and the overfill anilox roller 30 may be different to avoid matching surface land patterns between the anilox rollers.

The overfill roller assembly 18 may further include a smoothing member that rides on the non-rigid form roller 24 to help smooth out the overcoat layer of ink on the non-rigid form roller. The smoothing member may be a disturber roller 36 that may ride on the non-rigid form roller 24 to help smooth out any ink from the overfill anilox roller cell pattern. The disturber roller 36 may be soft coated or hard and may be configured to spread the ink on the surface of the non-rigid form roller 24 by contacting the ink. The disturber roller may be configured to rotate about a longitudinal axis, and may be configured to be movable axially. For example, the disturber roller 36 may oscillate along its longitudinal axis to provide additional smoothing and prevent ink ribbing instabilities. Specifically, the disturber roller 36 may move back and forth axially while rotating for enhanced spreading and smoothing of the overfill ink on the non-rigid form roller 24 before transfer of the ink to the anilox member 12. A smoothing may be configured, for example, to remove an anilox roll pattern from the overcoat ink layer metered onto the surface of the non-rigid form roller 24 from the overfill anilox roller 30. In an example the smoothing member may also be a metering member, such as a doctor blade.

Both anilox rollers 12, 30 and non-rigid form roller 24 would likely be driven, whereas, the disturber roller 36 may be driven by the non-rigid form roller. An additional advantage of the inking apparatus 10 is that the rotational speeds of rollers may be varied. For example, by varying the surface rotational speed of the overfill anilox roller 30 relative to the surface rotational speed of the non-rigid form roller 24, the amount of overfill ink can be fine-tuned to result in a thin uniform layer of overcoat ink (e.g., between 0.25 μm and 10 μm).

The inking apparatus 10 may further include a second smoothing member 66 that rides on the primary anilox roller 12 downstream the overfill roller assembly 18 after the overcoat layer of ink is added to the primary anilox roller to remove any patterning and ink instabilities in the combined overcoat and metered layers of ink before the combined layers of ink are transferred to the imaging member surface 22. The second smoothing member 66 may be substantially similar to the disturber roller 36. In other words, the second smoothing member 66 may be soft coated or hard and intentionally designed to spread the combined layers of ink on the surface of the primary anilox roller 12 by contacting the ink. Like the disturber roll 36, the second smoothing member may rotate about a longitudinal axis thereof, and may be movable axially. For example, the second smoothing member 66 may oscillate along its longitudinal axis to provide additional smoothing and prevent ink ribbing instabilities. Specifically, the second smoothing member 66 may move back and forth axially while rotating for enhanced spreading and smoothing of the combined overcoat and metered layers of ink on the primary anilox roller 12 before transfer of the ink to the imaging member surface 22 at the nip 28.

While not being limited to a particular theory, each of the anilox rollers 12, 30 may draw ink from a separate respective ink housing 40, 42. The ink housings may be part of the ink supply station 14 that is configured to supply ink to the anilox rollers. The ink supply station 14 maintains the ink that is transferred to the anilox rollers 12, 30. Accordingly the same ink, or type of ink, may be stored in the ink housings 40, 42 for transfer to the anilox rollers. In an example, the ink supply station 14 may store ink between the housings 40, 42 and move the ink as needed to the housings. For example, the ink supply station 14 may include an ink reservoir 46 as a central ink storage unit, and conduits 48, 50 between the ink reservoir and each ink housing 40, 42 that may transfer ink between the ink reservoir and the ink housings. The ink supply station 14 may also include one or more pumps, here identified by example as pumps 52, 54, configured to move ink between the ink reservoir 46 and the ink housings 40, 42 and maintain an amount of ink in each ink housing sufficient for transfer of the metered layer of ink to anilox roller 12 and the overcoat layer of ink to the anilox roller 30.

In examples where the overfill anilox roller 30 donates ink to the primary anilox roller 12, or where cells of the overfill anilox member 30 have a larger volume, ink from the ink housing 42 may be used faster than ink from the ink housing 40. In other examples ink from the ink housing 40 may be used faster than ink from the ink housing 42. In examples where ink is drawn from the ink housings 40, 42 at different rates, the pumps 52, 54 may be configured to move ink in a direction 38 from one ink housing to another ink housing as needed to maintain a sufficient level of ink in each housing for use by the inking apparatus 10. For example, FIG. 2 shows the ink supply station 14 as an ink management system with pumps 52, 54 configured to move ink from ink housing 40 to ink housing 42.

Figure 2:
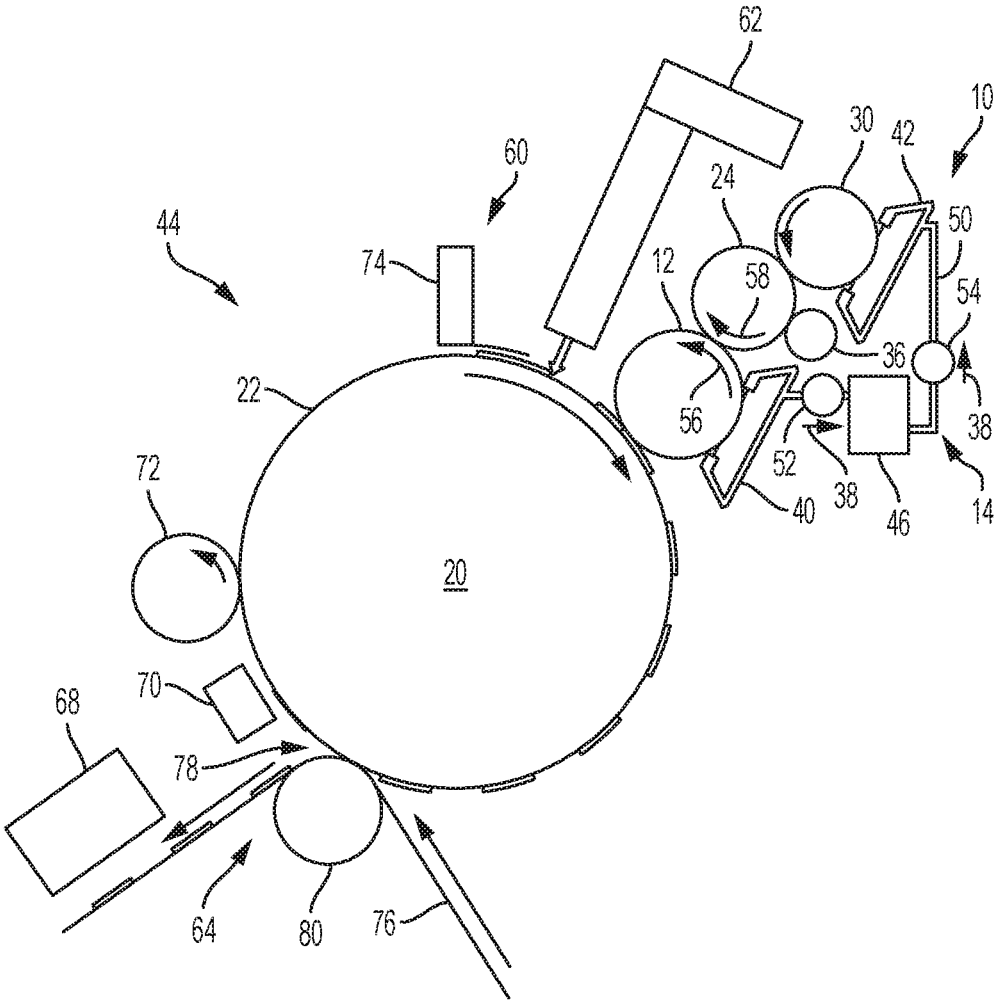
FIG. 2 is a block diagram of a variable data digital offset inking system using the inking apparatus illustrated by example in FIG. 1.

Still referring to FIGS. 1 and 2, the imaging member surface 22 may be wear resistant and flexible. The surface 22 may be reimageable and conformable, having an elasticity and durometer, and sufficient flexibility for coating ink over a variety of different media types having different levels of roughness. A thickness of the reimageable surface layer may be, for example, about 0.5 millimeters to about 4 millimeters. The surface 22 should have a weak adhesion force to the ink at the interface, yet good oleophilic wetting properties with the ink for promoting uniform inking of the reimageable surface and subsequent transfer lift of the ink onto a print substrate.

The soft, conformable surface 22 of the imaging member may include silicone. Other materials may be employed, including blends of polyurethanes, fluorocarbons, etc. The surface may be configured to conform to a print substrate on which the ink image is printed. To provide effective wetting of dampening fluids such as water-based fountain solution, the silicone surface need not be hydrophilic, but may be hydrophobic. Wetting surfactants, such as silicone glycol copolymers, may be added to the dampening fluid to allow the dampening fluid to wet the silicone surface. The imaging member may be a roll or drum, or may be a flat plate, surface of a belt, or other structure. It is understood that the terms dampening fluid and fountain solution are considered interchangeable.

FIG. 2 depicts a digital offset inking system 44 including the inking apparatus 10. The system may further include a dampening fluid applicator 60, an optical patterning subsystem 62, an ink image transfer station 64, rheological conditioning subsystems 68, 70 and a cleaning device 72. While FIGS. 1 and 2 show components that are formed as rollers, other suitable forms and shapes may be implemented.

The dampening fluid applicator 60 may be configured to deposit a layer of fountain solution onto the imaging member surface 22. While not being limited to particular configuration, the dampening fluid applicator 60 may include a series of rollers or sprays 74 for uniformly wetting the reimageable surface 22 with a uniform layer of a fountain solution (e.g., dampening fluid), with the thickness of the layer being controlled. The fountain solution may include water optionally with small amounts of isopropyl alcohol or ethanol added to reduce surface tension as well as to lower evaporation energy necessary to support subsequent laser patterning, as will be described in greater detail below. Low surface energy solvents, for example volatile silicone oils, can also serve as fountain solutions.

The optical patterning subsystem 62 is located downstream the dampening fluid applicator 60 in the printing processing direction to selectively pattern a latent image in the layer of fountain solution by image-wise patterning using, for example, laser energy. While the optical patterning subsystem 62 is shown as a laser emitter, it should be understood that a variety of different systems may be used to deliver the optical energy to pattern the fountain solution layer.

Following patterning of the fountain solution layer by the optical patterning subsystem 62, the patterned layer over the reimageable surface 22 is presented to the inking apparatus 10. The inker apparatus 10 is positioned downstream the optical patterning subsystem to apply a uniform layer of ink over the layer of fountain solution and the reimageable surface layer of the imaging member 20. The inking apparatus 10 may deposit the ink to the evaporated pattern representing the imaged portions of the reimageable surface 22, while ink deposited on the unformatted portions of the fountain solution will not adhere based on a hydrophobic and/or oleophobic nature of those portions. The inking apparatus may heat the ink before it is applied to the surface 22 to lower the viscosity of the ink for better spreading into the imaged portion pockets of the reimageable surface. For example, one or more rollers of the inking apparatus may be heated, as well understood by a skilled artisan. The heated rollers may be at least one of the anilox rollers 12, 30. By controlling the temperature of the ink to reach a desired ink viscosity, the amount of overfill ink can be fine-tuned to result in a thin uniform layer (e.g., between 0.25 μm and 10 μm) of overcoat ink.

Although the ink may be discussed herein as a UV-curable ink, the disclosed embodiments are not intended to be limited to such a construct. The ink may be a UV-curable ink or another ink that hardens when exposed to UV radiation. The ink may be another ink having a cohesive bond that increases, for example, by increasing its viscosity. For example, the ink may be a solvent ink or aqueous ink that thickens when cooled and thins when heated.

Downstream the inking apparatus 10 in the printing process direction resides the ink image transfer station 64 that transfers the ink image from the imaging member surface 22 to a print substrate 76. The transfer occurs as the substrate 76 is passed through a transfer nip 78 between the imaging member 20 and an impression roller 80 such that the ink within the imaged portion pockets of the reimageable surface 22 is brought into physical contact with the substrate 76.

Rheological conditioning subsystems 68, 70 may be used to increase the viscosity of the ink at specific locations of the digital offset inking system 44 as desired. While not being limited to a particular theory, the rheological conditioning subsystems 68, 70 may include a curing mechanism, such as a UV curing lamp (e.g., standard laser, UV laser, high powered UV LED light source), wavelength tunable photoinitiator, or other UV source, that exposes the ink to an amount of UV light (e.g., # of photons radiation) to partially cure the ink/coating to a tacky state. The curing mechanism may include various forms of optical or photo curing, thermal curing, electron beam curing, drying, or chemical curing. In the exemplary digital offset inking system 44 depicted in FIG. 2, a first rheological conditioning subsystem 68 may be positioned adjacent the substrate 76 downstream the ink image transfer station 64 to cure the ink image transferred to the substrate. A second rheological conditioning subsystem 70 may be positioned adjacent the imaging member surface 22 between the ink image transfer station 64 and the cleaning device 72 as a preconditioner to harden any residual ink for easier removal from the imaging member surface 22 that prepares the surface to repeat the digital image forming operation.

This residual ink removal is most preferably undertaken without scraping or wearing the imageable surface of the imaging member. Removal of such remaining fluid residue may be accomplished through use of some form of cleaning device 72 adjacent the surface 22 between the ink image transfer station 64 and the dampening fluid applicator 60. Such a cleaning device may include at least a first cleaning member such as a sticky or tacky roller in physical contact with the imaging member surface 22, with the sticky or tacky member removing residual fluid materials (e.g., ink, dampening fluid) from the surface. The sticky or tacky member may then be brought into contact with a smooth roller (not shown) to which the residual fluids may be transferred from the sticky or tacky member, the fluids being subsequently stripped from the smooth roller by, for example, a doctor blade or other like device and collected as waste. It is understood that the cleaning device 72 is one of numerous types of cleaning devices and that other cleaning devices designed to remove residual ink/dampening fluid from the surface of a reimageable printing system imaging member are considered within the scope of the embodiments. For example, the cleaning device could include at least one roller, brush, web, belt, tacky roller, buffing wheel, etc., as well understood by a skilled artisan.

Figure 3:
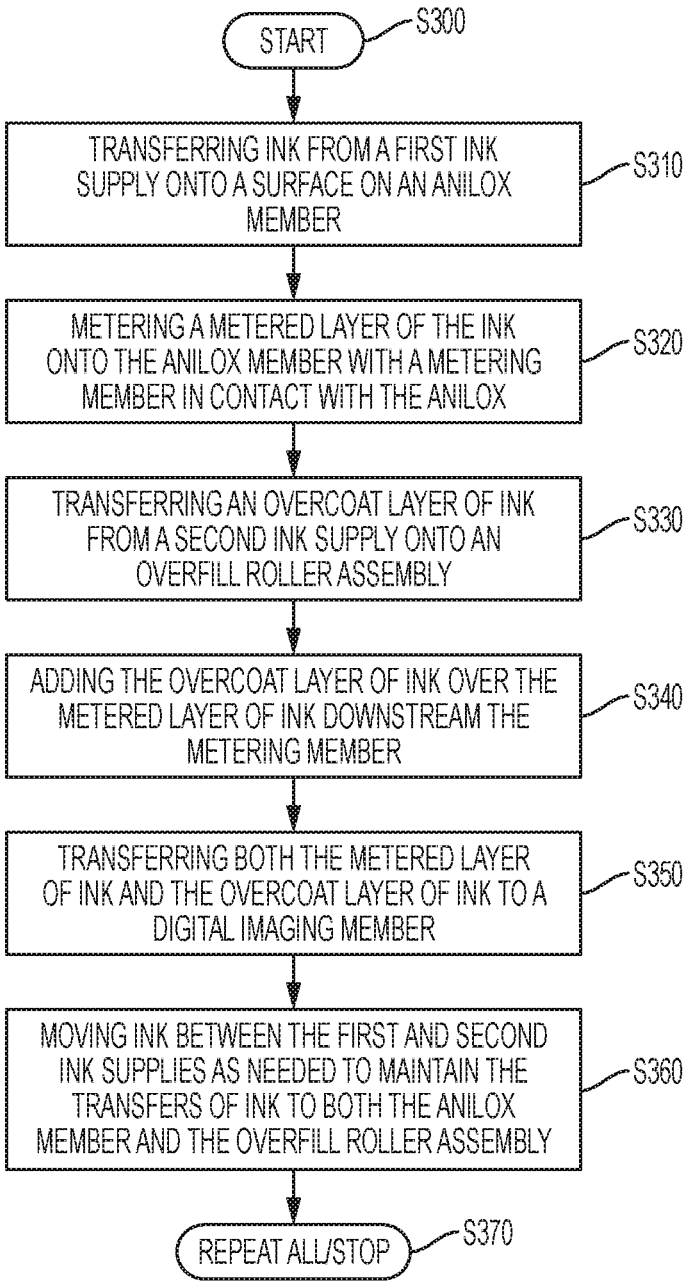
FIG. 3 is a flowchart depicting the operation of an exemplary inking apparatus configured for use in a variable data digital offset inking system.

The disclosed embodiments may include an exemplary inkjet printing method implementing a flood coat layer application and inkjet image forming deposition. FIG. 3 illustrates a flowchart of such an exemplary method. As shown in FIG. 3, operation of the method commences at Step S300 and proceeds to Step S310.

In Step S310, ink from an ink supply station is transferred onto a surface of a primary anilox member. The primary anilox member surface may include wells defined therein to receive and carry the ink for transfer to a digital imaging member. Operation of the method proceeds to Step S320, where a layer of the ink is metered from the transferred ink onto the surface of the primary anilox member with a metering member in contact with the primary anilox member. The metering member may be a doctor blade configured to remove excess ink transferred to the primary anilox member from the ink supply resulting in a metered layer of the ink on the primary anilox member surface. The primary anilox member may also heat the metered layer of ink to fine tune the ink thickness as desired. Operation of the method proceeds to Step S330.

In Step S330, an overcoat layer of ink is transferred from a second ink supply onto an overfill roller assembly. This step may include transferring ink from the second ink supply onto a surface of an overfill anilox roller, and transferring that ink from the overfill anilox roller onto an overfill form roller. The overfill anilox roller may also heat the overcoat layer of ink to fine tune the ink thickness as desired. The overcoat layer of ink on the overfill form roller may be smoothed out via a smoothing roller riding on the overfill form roller. The smoothing roller may be oscillated along a longitudinal axis thereof to enhance the smoothing of the overcoat layer of ink on the overfill form roller. This smoothing may be fine-tuned by varying the surface rotational speed of the overfill anilox roller relative to the surface rotational speed of the overfill form roller.

Operation of the method proceeds to Step S340, where the overcoat layer of ink is coated over the metered layer of ink. This step may be accomplished by adding the overcoat layer onto the metered layer downstream the metering member via the overfill form roller of the overfill roller assembly. A second smoothing roller may ride on the primary anilox member downstream the overfill roller assembly to remove any patterning and ink instabilities in the combined overcoat and metered layers of ink. This smoothing may be enhanced by varying the surface rotational speed of the second smoothing roller relative to the surface rotational speed of the primary anilox member. Operation of the method may proceed to Steps S350.

In Step S350, both the metered layer of ink and the overcoat layer of ink are transferred to a digital imaging member resulting in a thin layer of the ink (e.g., between 0.25 μm and 10 μm) on the digital imaging member surface free of ink voids. In Step S360, ink in the first and second ink supplies may be moved or pumped as needed to keep the ink supplies sufficiently filled to continue transferring ink to the primary anilox member and the overfill form roller. Operation may cease at Step S370, or may continue by repeating back to Step S310, where more ink may be transferred from the first ink supply to the primary anilox member.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 3, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An inking system for offset printing, comprising:

an anilox member, the anilox member having a surface including wells defined therein, the surface configured to receive and carry ink for transfer to a digital imaging member;

an ink supply station in liquid communication with the anilox member to transfer an initial portion of the ink to the surface of the anilox member;

a metering member in contact with the anilox member, the metering member configured to remove excess ink of the initial portion of ink supplied to the anilox member off lands of the surface of the anilox member resulting in a metered layer of ink on the anilox member, the lands including the top outer surface of the anilox member; and an overfill roller assembly in rolling contact with the anilox member, the overfill roller assembly including an overfill form roller configured to add an overcoat layer of ink on the metered layer of ink and the lands downstream the metering member to cover the anilox member surface for transfer of both the metered layer of ink and the overcoat layer of ink over the lands between the anilox wells to the digital imaging member, the overcoat layer of ink including ink added over the lands of the surface of the anilox member rendered free of the initial portion of ink by the metering member.

2. The inking system of claim 1, wherein the overfill roller assembly includes an overfill ink anilox roller between the overfill form roller and a second layer ink supply to transfer the overcoat layer of the ink to the overfill form roller.

3. The inking system of claim 1, further comprising a smoothing roller riding on the overfill form roller to smooth out the overcoat layer of the ink prior to transfer thereof to the anilox member.

4. The inking system of claim 3, the smoothing roller having a longitudinal shaft axis and being rotatable about the longitudinal shaft axis against the overfill form roller, the smoothing roller being movable along the longitudinal shaft axis for enhanced smoothing of the overcoat layer of the ink.

5. The inking system of claim 1, further comprising a smoothing roller in rolling contact with the anilox member downstream the overfill roller assembly to smooth out the overcoat layer of ink and the metered layer of ink on the anilox member.

6. The inking system of claim 1, the ink supply station including an ink supply storing the ink, wherein the anilox member is submerged in the stored ink and rotatable there through to pick up the initial portion of the ink.

7. The inking system of claim 1, wherein the overfill form roller has an outer surface compatible with the ink.

8. The inking system of claim 1, the ink supply station including a first ink supply configured to transfer the initial portion of the ink to the surface of the anilox member, and a second ink supply configured to transfer the overcoat layer of the ink to the overfill form roller.

9. The inking system of claim 8, wherein the first ink supply and the second ink supply share the same ink, the ink supply station further including a central ink reservoir storing the ink between the first ink supply and the second ink supply, and an ink management system configured to move the ink between the first ink supply and the second ink supply.

10. The inking system of claim 9, wherein the ink management system includes a pump between the first ink supply and the second ink supply to move the ink from the first ink supply to the second ink supply.

11. An inking method for offset printing, comprising:

transferring ink from an ink supply station onto a surface of an anilox member, the surface including wells defined therein to receive and carry the ink for transfer to a digital imaging member;

metering a metered layer of the ink from the transferred ink onto the surface of the anilox member with a metering member in contact with the anilox member, the metering member configured to remove excess ink transferred to the anilox member off lands of the surface of the anilox member resulting in a metered layer of the ink on the anilox member, the lands including the top outer surface of the anilox member;

adding an overcoat layer of the ink on the metered layer of ink and the lands downstream the metering member with an overfill roller assembly including an overfill form roller in rolling contact with the anilox member to cover the anilox member surface and form a combined metered and overcoat layer of ink, the overcoat layer of ink including ink added over the lands of the surface of the anilox member rendered free of the initial portion of ink by the metering member; and transferring the combined metered and overcoat layer of ink over the lands between the anilox wells to the digital imaging member.

12. The method of claim 11, the adding step including transferring the overcoat layer of the ink to the overfill form roller via an overfill ink pickup anilox roller further comprising removing ink thickness inconsistencies in the overcoat layer of the ink by varying a surface rotational speed of the overfill ink pickup anilox roller relative to a surface rotational speed of the overfill form roller.

13. The method of claim 11, the adding step including smoothing out the overcoat layer of the ink prior to transfer thereof to the anilox member with a smoothing roller riding on the overfill form roller.

14. The method of claim 13, further comprising oscillating the smoothing roller along a longitudinal shaft axis thereof for enhanced smoothing of the overcoat layer of the ink.

15. The method of claim 11, the ink supply station including a first ink supply configured to transfer the initial portion of the ink to the surface of the anilox member, and a second ink supply configured to transfer the overcoat layer of the ink to the overfill form roller, the method further comprising moving the ink to the first ink supply and the second ink supply via an ink management system, and pumping the ink from the first ink supply to the second ink supply via a pump therebetween.

16. The method of claim 11, further comprising removing any patterning and ink instabilities in the combined overcoat and metered layer of ink before the combined layers of ink are transferred to the digital imaging member via a smoothing roller in rolling contact with the anilox member downstream the overfill roller assembly.

17. The method of claim 11, further comprising controlling the viscosity of the overcoat layer of the ink and the metered layer of the ink.

18. An inker, comprising:

an anilox member, the anilox member having a surface including wells defined therein, the surface configured to receive and carry ink for transfer to a digital imaging member;

an ink chamber in liquid communication with the anilox member to transfer an initial portion of the ink to the surface of the anilox member;

a doctor blade in contact with the anilox member, the doctor blade configured to scrape excess ink of the initial portion of the ink supplied to the anilox member off lands of the surface of the anilox member resulting in a metered layer of the ink on the anilox member, the lands including the top outer surface of the anilox member; and an overfill roller assembly in rolling contact with the anilox member, the overfill roller assembly including an overfill form roller configured to add an overcoat layer of the ink on the metered layer of ink and the lands downstream the doctor blade to cover the anilox member surface for transfer of both the metered layer of ink and the overcoat layer of the ink over the lands between the anilox wells to the digital imaging member, the overcoat layer of ink including ink added over the lands of the surface of the anilox member rendered free of the initial portion of ink by the doctor blade;

the ink chamber including a first ink supply configured to transfer the initial portion of the ink to the surface of the anilox member, a second ink supply configured to transfer the overcoat layer of the ink to the overfill form roller, and an ink management system configured to move the ink to the first ink supply and the second ink supply, wherein the overfill roller assembly further includes an overfill ink anilox roller between the overfill form roller and the second ink supply to transfer the overcoat layer of the ink to the overfill form roller.

19. The inker of claim 18, further comprising a smoothing roller riding on the overfill form roller to smooth out the overcoat layer of the ink prior to transfer thereof to the anilox member, the smoothing roller having a longitudinal shaft axis and being rotatable against the overfill form roller about the longitudinal shaft axis, the smoothing roller movable along the longitudinal shaft axis for enhanced smoothing of the overcoat layer of the ink.

20. The inker of claim 18, wherein the ink management system includes a pump between the first ink supply and the second ink supply to pump the ink from the first ink supply to the second ink supply for ink transfer to the overfill form roller.

* * * * *